US008808025B2

(12) United States Patent
Sekine et al.

(10) Patent No.: US 8,808,025 B2
(45) Date of Patent: Aug. 19, 2014

(54) ELECTRICAL CONNECTION TERMINAL AND CONNECTOR USING SAME

(75) Inventors: Takashi Sekine, Kanagawa (JP); Kenichi Yamaguchi, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 0 days.

(21) Appl. No.: 13/819,502

(22) PCT Filed: Jan. 11, 2012

(86) PCT No.: PCT/JP2012/050337

§ 371 (c)(1), (2), (4) Date: Feb. 27, 2013

(87) PCT Pub. No.: WO2012/096286

PCT Pub. Date: Jul. 19, 2012

(65) Prior Publication Data

US 2013/0288514 A1 Oct. 31, 2013

(30) Foreign Application Priority Data

Jan. 12, 2011 (JP) ..... 2011-004054

(51) Int. Cl.

| | |
|---|---|
| ***H01R 4/24*** | (2006.01) |
| ***H01R 12/51*** | (2011.01) |
| ***H01R 4/10*** | (2006.01) |
| ***H01R 4/48*** | (2006.01) |
| *H01R 12/72* | (2011.01) |
| *F21V 23/06* | (2006.01) |
| *F21K 99/00* | (2010.01) |
| *F21V 19/00* | (2006.01) |
| *F21Y 101/02* | (2006.01) |
| *F21V 3/00* | (2006.01) |

(52) U.S. Cl.

CPC ..... *H01R 4/10* (2013.01); *H01R 12/721* (2013.01); *F21V 23/06* (2013.01); *H01R 12/515* (2013.01); *H01R 4/24* (2013.01); *F21K 9/135* (2013.01); *F21V 19/004* (2013.01); *H01R 4/2404* (2013.01); *F21Y 2101/02* (2013.01); *H01R 4/4818* (2013.01); *F21V 3/00* (2013.01)

USPC ..... 439/389; 439/851

(58) Field of Classification Search

USPC ..... 439/389, 682, 851

See application file for complete search history.

(56) References Cited

U.S. PATENT DOCUMENTS

| | | | | |
|---|---|---|---|---|
| 6,012,944 | A * | 1/2000 | Hatakeyama | 439/441 |
| 6,128,181 | A * | 10/2000 | Higami et al. | 361/600 |
| 6,276,955 | B1 * | 8/2001 | Hollesen et al. | 439/441 |
| 2010/0026157 | A1 | 2/2010 | Tanaka et al. | |

FOREIGN PATENT DOCUMENTS

| | | | |
|---|---|---|---|
| JP | 07-272812 | A | 10/1995 |
| JP | 09-050837 | A | 2/1997 |

(Continued)

*Primary Examiner* — Neil Abrams
*Assistant Examiner* — Travis Chambers
(74) *Attorney, Agent, or Firm* — Lowe Hauptman & Ham, LLP

(57) ABSTRACT

An electrical connection terminal for securely retaining a connection object without degrading connection reliability, and a connector using the electrical connection terminal. A first contacting portion adapted to cut into a lead wire of a cable to restrict displacement thereof in a counter-insertion direction is provided in the leading-end corner of a first contact piece of a terminal, and a second contacting portion with which the lead wire slidably makes contact is provided on the leading end of a second contact piece of the terminal. Disconnection of the lead wire is prevented by means of the first contacting portion and securing a sufficient area of connect with the lead wire by the second contacting portion. The second contacting portion is formed by chamfering the leading-end corner of the second contact piece. Accordingly, the leading-end side of the second contact piece need not be bent to form a curved-surface contacting portion.

8 Claims, 13 Drawing Sheets

(56) References Cited

FOREIGN PATENT DOCUMENTS

| | | | |
|---|---|---|---|
| JP | 10-340745 | A | 12/1998 |
| JP | 2005-004965 | A | 1/2005 |
| JP | 2010-033959 | A | 2/2010 |
| JP | 1385523 | S | 4/2010 |

* cited by examiner

ELECTRICAL CONNECTION TERMINAL AND CONNECTOR USING SAME

TECHNICAL FIELD

The present invention relates to an electrical connection terminal used to connect between the board of a bulb-type lamp using, for example, an LED and a power supply cable, and to a connector using the electrical connection terminal.

BACKGROUND ART

A lamp comprising a main body to be fitted on lighting equipment, a board mounted with an LED, and a curved-surface cover for covering the board, so as to emit the light of the LED on the board to the outside through the cover is generally known as a bulb-type lamp using an LED (see, for example, Patent Literature 1). Like a conventional bulb, this bulb-type lamp includes, in the main body thereof, a base to be threadably fitted into a socket of lighting equipment, so that external power is supplied to the LED through wires connecting between the base and the board. In this case, the board is fitted with a connector for connecting between a wiring cable and the conductive pattern of the board.

The connector used in this bulb-type lamp includes a connector main body to be inserted into a mounting hole provided in the board and a terminal retained in the connector main body, so that one end of the terminal is connected to an LED-mounted surface of the board and a cable is connected to the other end of the terminal (see, for example, Patent Literature 2).

As the terminal to which a cable is connected, there is known a terminal which includes an elastically deformable contact piece for contact with a lead wire of a cable and in which the contact piece, while being elastically deformed, is crimped onto the lead wire inserted into a cable insertion port of the connector (see, for example, Patent Literature 3, 4 or 5).

CITATION LIST

Patent Literature

Patent Literature 1: Japanese Patent Publication 2010-33959
Patent Literature 2: Design Registration 1385523
Patent Literature 3: Japanese Patent Publication 9-50837
Patent Literature 4: Japanese Patent Publication 7-272812
Patent Literature 5: Japanese Utility Model Publication 5-90823

SUMMARY OF INVENTION

Technical Problem

In a conventional terminal, the leading-end corner of a contact piece is formed so as to cut into a lead wire to restrict the displacement thereof. Thus, the lead wire can be prevented from being disconnected. This terminal has the problem, however, that the area of contact between the contact piece and the lead wire is small, and therefore, connection reliability degrades. A sufficient area of contact between the contact piece and the lead wire can be secured and connection reliability can be enhanced by bending the leading-end side of the contact piece to form a curved-surface contacting portion and allowing the contacting portion to have surface contact with the lead wire. If the contacting portion is made to have surface contact with the lead wire, however, the lead wire is liable to slide with respect to the contact piece. Consequently, the conventional terminal has the problem that it is no longer possible to prevent the lead wire from being disconnected, thus failing to securely hold the lead wire.

The present invention has been accomplished in view of the above-described problems, and an object of the invention is to provide an electrical connection terminal capable of securely retaining a connection object without degrading connection reliability, and a connector using the electrical connection terminal.

Solution to Problem

In order to achieve the aforementioned object, an electrical connection terminal according to the present invention comprises first and second contact pieces disposed oppositely to each other in the thickness direction thereof and is connected to a connection object through the respective contact pieces as the result of the connection object being inserted therebetween, wherein the first and second contact pieces are obliquely formed so that the leading-end sides thereof extending toward an insertion direction of the connection object come close to each other and that the respective contact pieces are elastically deformable in the mutually-opposed direction thereof; a first contacting portion adapted to cut into the connection object to restrict the displacement thereof in a counter-insertion direction is provided in the leading-end corner of the first contact piece; a second contacting portion with which the connection object slidably makes contact is provided in the leading end of the second contact piece; and the second contacting portion is formed by chamfering the leading-end corner of the second contact piece.

Consequently, the first contacting portion of the first contact piece makes contact with the connection object, so as to cut thereinto, thereby restricting the displacement of the connection object in the counter-insertion direction thereof and preventing the connection object from being disconnected. On the other hand, the second contacting portion of the second contact piece slidably makes contact with the connection object without cutting thereinto, thereby securing a sufficient area of contact between the second contact piece and the connection object. Since the second contacting portion is formed by chamfering the leading-end corner of the second contact piece in this case, the leading-end side of the second contact piece need not be bent to form a curved-surface contacting portion.

Advantageous Effects of Invention

According to the present invention, the first contacting portion can prevent the connection object from being disconnected, and the second contacting portion can secure a sufficient area of contact with the connection object. Consequently, the connection object can be securely retained without degrading connection reliability. Since the leading-end side of the second contact piece need not be bent to form a curved-surface contacting portion, the second contact piece can be easily formed into a simple shape.

DESCRIPTION OF EMBODIMENTS

FIGS. 1 to 21 illustrate one embodiment of the present invention. A connector illustrated in the figures is mounted on the board of a bulb-type lamp using an LED to connect between a power supply cable which is a connection object and the board.

Figure 21:
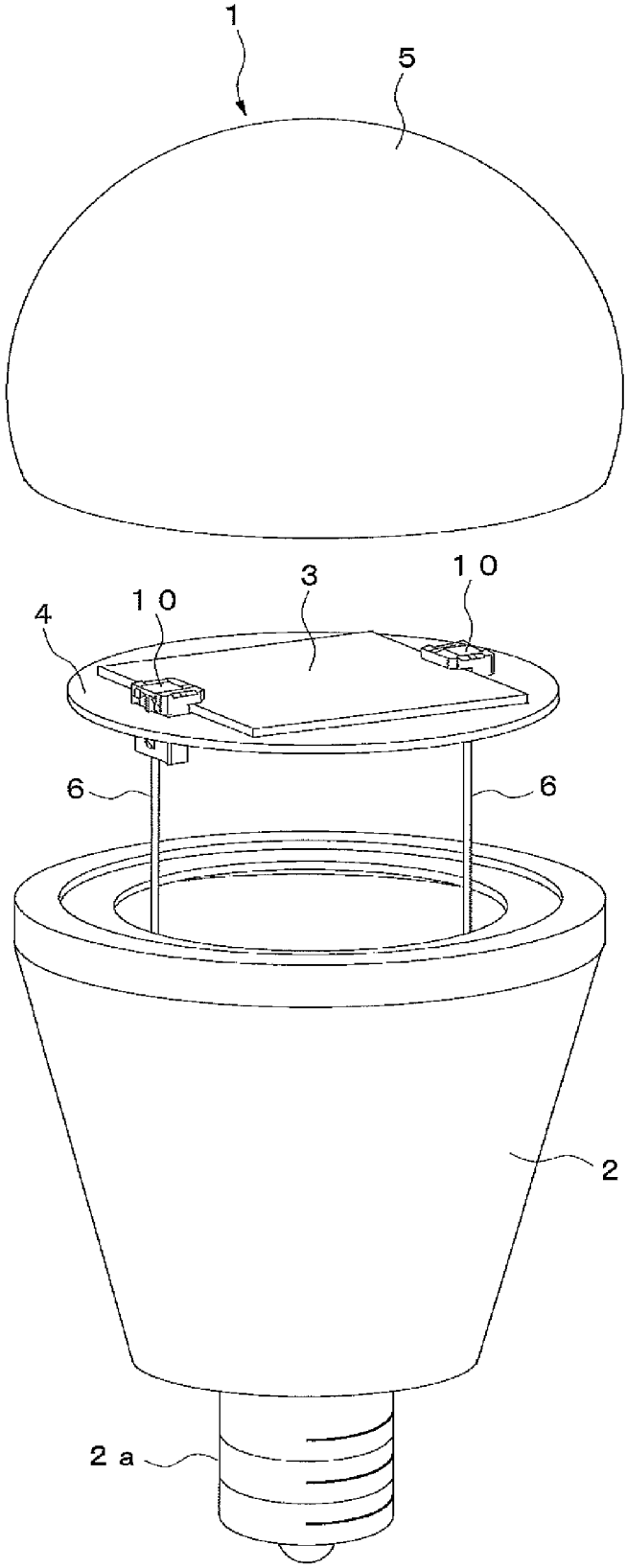
FIG. 21 is an exploded perspective view of a bulb-type lamp.

A bulb-type lamp 1 illustrated in FIG. 21 comprises a main body 2 to be mounted on lighting equipment; an LED board 3 on the top surface of which an LED (not illustrated) is mounted; a mounting board 4 on the top surface of which the LED board 3 is mounted; and a curved-surface cover 5 for covering the LED board 3 and the mounting board 4, wherein LED light is emitted to the outside through the cover 5.

The main body 2 is made of a hollow case having an opening in the top surface thereof and includes, in the lower end thereof, a base 2*a* to be threadably fitted into a socket (not illustrated) of lighting equipment. The base 2*a* is connected to the LED board 3 through cables 6, so that external power is supplied from the base 2*a* to the LED board 3.

Figure 17:
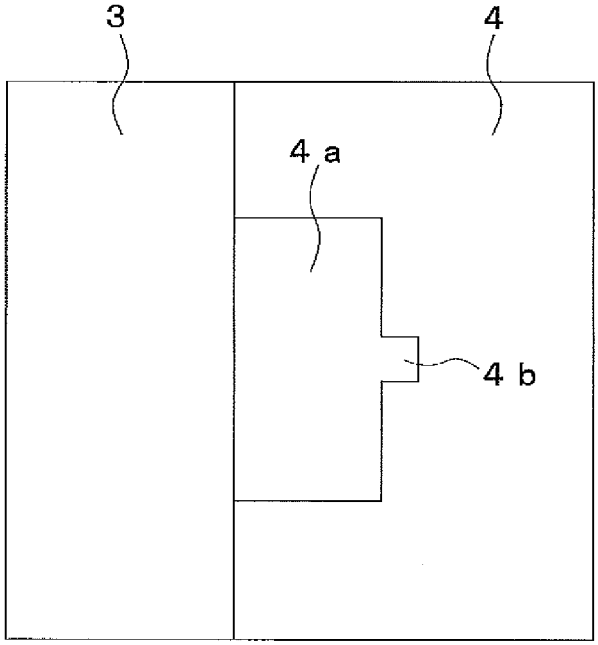
FIG. 17 is a partial plan view of the LED board and the mounting board.
Figure 18:
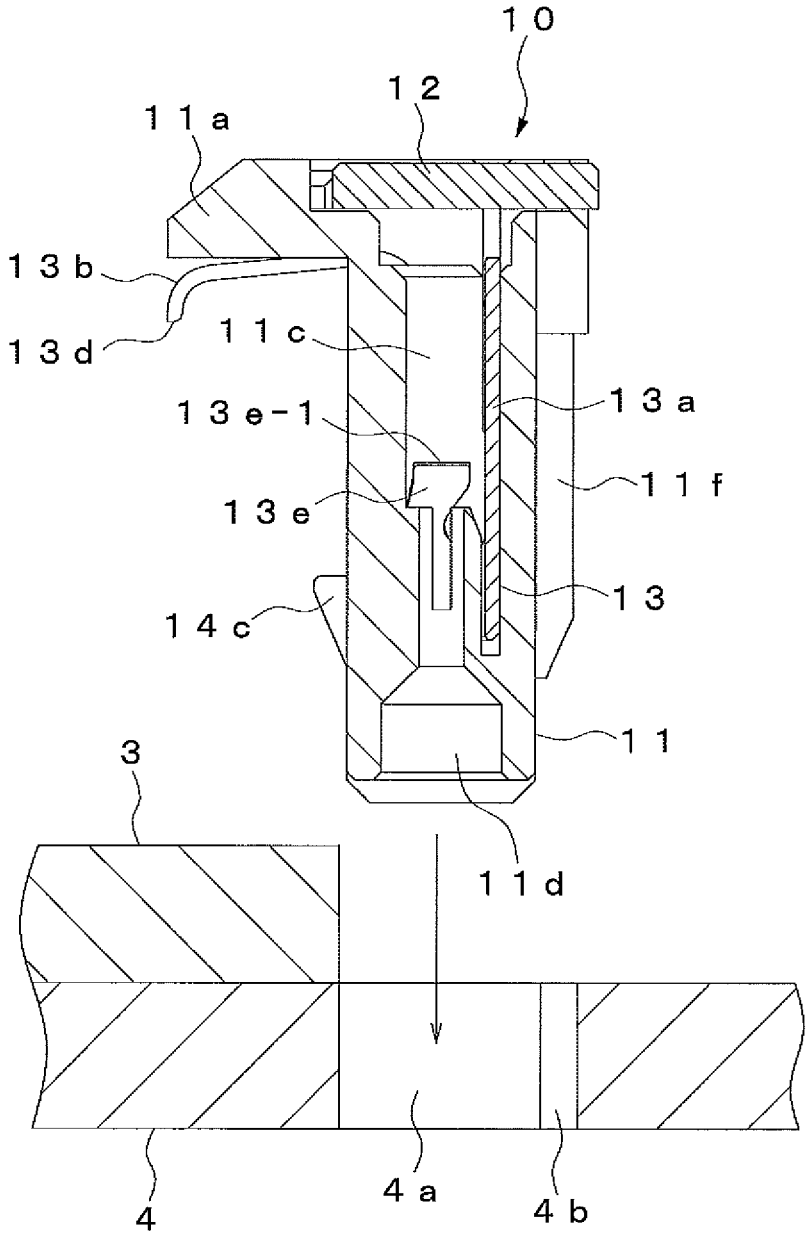
FIG. 18 is a cross-sectional side view illustrating a step of mounting the connector.
Figure 20:
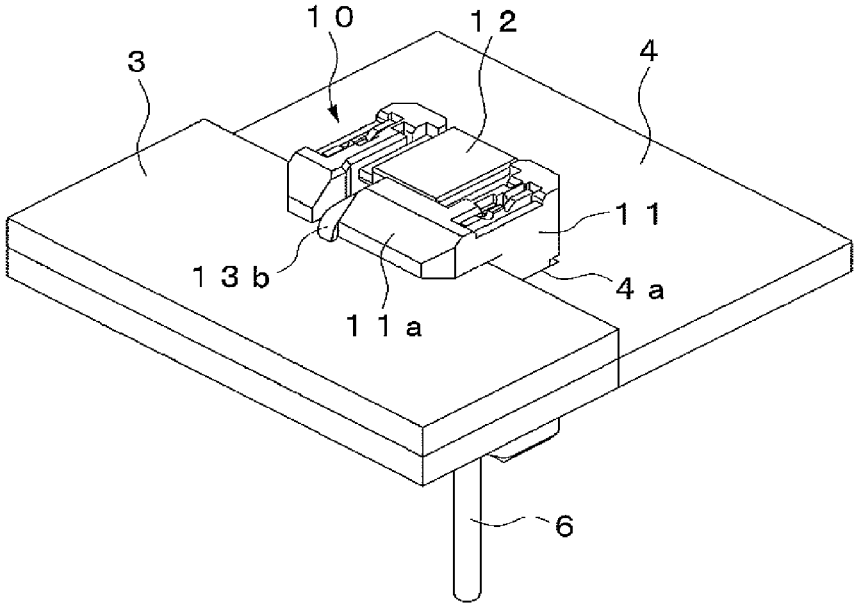
FIG. 20 is a partial perspective view illustrating a state of the LED board and the mounting board mounted with the connector.

The LED board 3 is formed into a quadrangular shape and fixed on the mounting board 4, so as to overlap on the top surface thereof. One LED formed into a sheet shape or a plurality of chip-type LEDs, for example, is mounted on the LED board 3. Note that FIGS. 18, 17 and 20 show only portions of the LED board 3 and the mounting board 4.

The mounting board 4 is formed into a disk shape, so as to be fixed on the top surface of the main body 2. Connectors 10 for connecting between the cables 6 and the LED board 3 are mounted on the mounting board 4. Each connector 10 is fitted into a mounting hole 4*a* provided in the mounting board 4. The mounting holes 4*a* are composed of quadrangular through-holes disposed at both ends of the LED board 3. Each mounting hole 4*a* is formed so that one widthwise inner side surface thereof is flush with an end face of the LED board 3. In addition, a later-described concave portion 4*b* with which part of each connector 10 engages is provided in the other widthwise inner side surface of each mounting hole 4*a*.

Each connector 10 comprises a connector main body 11 to be inserted into a mounting hole 4*a* of the mounting board 4; a top cover 12 for covering the top surface of the connector main body 11; an electrical connection terminal 13 retained in the connector main body 11; and a pair of lock members 14 used to fix the connector main body 11 on the mounting board 4, wherein one end of the terminal 13 is connected to the top surface (one surface in the thickness direction) of the LED board 3, and a cable 6 is connected to the other end of the terminal 13.

The connector main body 11 is made of a molded synthetic-resin component and formed into a vertically-long rectangular solid in which the anteroposterior size of the connector main body is smaller than the widthwise size thereof. A forward-extending extension part 11*a* is provided on the top surface side of the connector main body 11, and a cutaway portion lib penetrating through one end of the terminal 13 is provided closer to one widthwise end of the extension part 11*a*. A terminal housing 11*c* for housing the terminal 13 is provided within the connector main body 11, and the top surface of the terminal housing 11*c* is open to the top surface of the connector main body 11. A circular insertion port 11*d* into which a cable 6 is inserted is provided in a portion of the bottom surface of the connector main body 11 closer to the other widthwise end thereof. The insertion port 11*d* is communicated into the terminal housing 11*c*. Retention holes 11*e* for retaining the respective lock members 14 are provided on both widthwise inner sides of the connector main body 11. Each retention hole 11*e* is created in the front surface of the connector main body 11, so as to extend in the vertical direction thereof. A rib 11*f* extending in the vertical direction is provided protrusively on the back surface of the connector main body 11, and is located in the widthwise middle of the connector main body 11.

The top cover 12 is formed into a quadrangular flat-plate shape to cover the top-surface opening of the terminal housing 11*c*, and attached to the connector main body 11 from the backside thereof, so as to be fitted on the top surface side of the connector main body 11. Flanged portions 12*a* extending in the anteroposterior direction are provided on both widthwise sides of the top cover 12. The respective flanged portions 12*a* are locked into a pair of widthwise locking parts 11*g* from therebelow provided at the rear end of the top-surface opening of the terminal housing 11*c*. In addition, a forward-projecting protruding portion 12*b* is provided at the anterior end of the top cover 12. The protruding portion 12*b* is configured to engage with a hole 11*h* provided on the anterior end side of the top-surface opening of the terminal housing 11*c*.

The terminal 13 is made of a conductive metal plate having been subjected to bending work and housed in the terminal housing 11*c* of the connector main body 11 from the top-surface opening of the terminal housing 11*c*. The terminal 13 comprises a fixing piece 13*a* formed into a flat-plate shape; a board connecting portion 13*b* extending from one widthwise end of the fixing piece 13*a*; and a cable connecting portion 13*c* extending from the other widthwise end of the fixing piece 13*a*.

The fixing piece 13*a* is fixed on the terminal housing 11*c* as the result of both widthwise ends of the fixing piece being crimped on an inner surface of the terminal housing 11*c*.

The board connecting portion 13*b* is formed so as to extend downward from the fixing piece 13*a*, bend upward, and further extend forward. The board connecting portion 13*b* is formed so as to be elastically deformable in the vertical direction (thickness direction of the LED board 3 and the mounting board 4). A contacting portion 13*d* for abutment with the LED board 3 is provided in the leading end of the board connecting portion 13*b*, so as to bend downward.

The cable connecting portion 13*c* extends downward from the fixing piece 13*a*. A pair of widthwise first and second contact pieces 13*e* and 13*f* for clamping therebetween the lead wire 6*a* of a cable 6 are provided on both widthwise sides of the cable connecting portion 13*c*, so as to be opposed to each other. The respective contact pieces 13*e* and 13*f* are formed by bending and raising both widthwise sides of the extension part 13*g* (predetermined portion of the terminal main body) extending downward from the fixing piece 13*a*, so as to be opposed to each other. In addition, the contact pieces 13*e* and 13*f* are obliquely formed so that the leading-end sides thereof extending upward come close to each other. In this case, the leading-end sides of the respective contact pieces 13*e* and 13*f* are formed so as to be elastically deformable in the width direction of the cable connecting portion 13*c* (in a direction in which the respective contact pieces 13*e* and 13*f* are opposed). A first contacting portion 13*e*-1 adapted to cut into the lead wire 6*a* of a cable 6 to make contact therewith is provided in the leading-end corner of the first contact piece 13*e*. The first contacting portion 13*e*-1 is formed of a corner the cross section of which forms a substantially right angle. A second contacting portion 13*f*-1 adapted to slidably make surface contact with the lead wire 6*a* of a cable 6 is provided in the leading end of the second contact piece 13*f*. The second contacting portion 13*f*-1 is formed by chamfering the leading-end corner of the second contact piece 13*f* into a curved-surface shape. In this case, the respective contacting portions 13*f*-1 and 13*e*-1 are disposed so as to be opposed to each other in the width direction of the cable connecting portion 13*c* (a direction orthogonal to the insertion direction of the cable 6).

Each lock member 14 is made of a punched-out metal plate, and retained within the retention hole 11*e* of the connector main body 11. Each lock member 14 comprises a fixing piece 14*a* extending within the retention hole 11*e* from the upper end to the lower end thereof; a springy piece portion 14*b* extending from the fixing piece 14*a*; and a locking part 14*c* provided in the leading end of the springy piece portion 14*b*, wherein the locking part 14*c* is locked to the bottom surface (the other surface in the thickness direction) of the mounting board 4. Each fixing piece 14*a* is fixed into the retention hole 11*e* by crimping the anteroposterior ends thereof on the upper end side and the anteroposterior ends thereof on the lower end side onto the inner surfaces of the retention hole 11*e*. The springy piece portion 14*b* is formed so as to extend downward in front of the fixing piece 14*a* and bend upward. The locking part 14*c* is formed so as to project forward from the leading end of the springy piece portion 14*b* and, thus, projects from the connector main body 11 through the opening of the retention hole 11*e*. In this case, the upper end of the locking part 14*c* is formed horizontally and the lower end thereof is formed obliquely so as to slope down backward.

Figure 19:
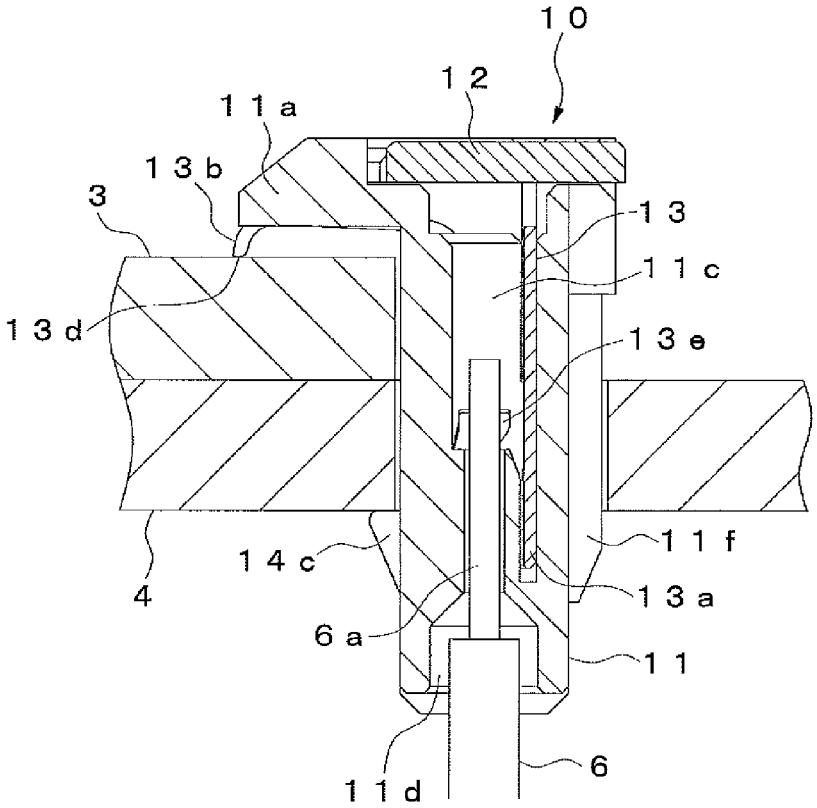
FIG. 19 is a cross-sectional side view illustrating a mounted state of the connector.

When the connector 10 configured as described above is mounted on the LED board 3 and the mounting board 4, the connector main body 11 is inserted from above the mounting board 4 into the mounting hole 4*a* thereof, as illustrated in FIG. 18. At that time, the rib 11*f* of the connector main body 11 engages with the concave portion 4*b* of the mounting hole 4*a*. When the locking part 14*c* of each lock member 14 abuts on the upper edge of the LED board 3 at the time of inserting the connector main body 11, the springy piece portion 14*b* deforms elastically as the locking part 14*c* moves backward due to the lower end slope thereof. Thereafter, when the locking part 14*c* climbs over an inner surface of the mounting hole 4*a*, the springy piece portion 14*b* restores its original state and the locking part 14*c* moves forward. Thus, the locking part 14*c* is locked onto the bottom surface of the mounting board 4, as illustrated in FIG. 19. In addition, at the time of the above-described insertion, the contacting portion 13*d* of the board connecting portion 13*b* of the terminal 13 abuts on the top surface of the LED board 3, the board connecting portion 13*b* elastically deforms upward, and the contacting portion 13*d* makes pressure contact with the LED board 3 by the restorative force of the board connecting portion 13*b*. Consequently, the board connecting portion 13*b* electrically conducts to a conductive pattern (not illustrated) of the LED board 3, and the terminal 13 is connected to the LED board 3. At that time, the board connecting portion 13*b* of the terminal 13 is held in a state of having pressure contact with the top surface of the LED board 3, and the connector 10 fitted in the mounting hole 4*a* is restricted in the vertical displacement thereof with respect to the LED board 3 and the mounting board 4, as the result of the locking part 14*c* of each lock member 14 being locked to the bottom surface of the mounting board 4. In addition, the connector 10 is restricted in the widthwise displacement thereof as the result of the rib 11*f* of the connector main body 11 and the concave portion 4*b* of the mounting hole 4*a* being engaged with each other.

Figure 1:
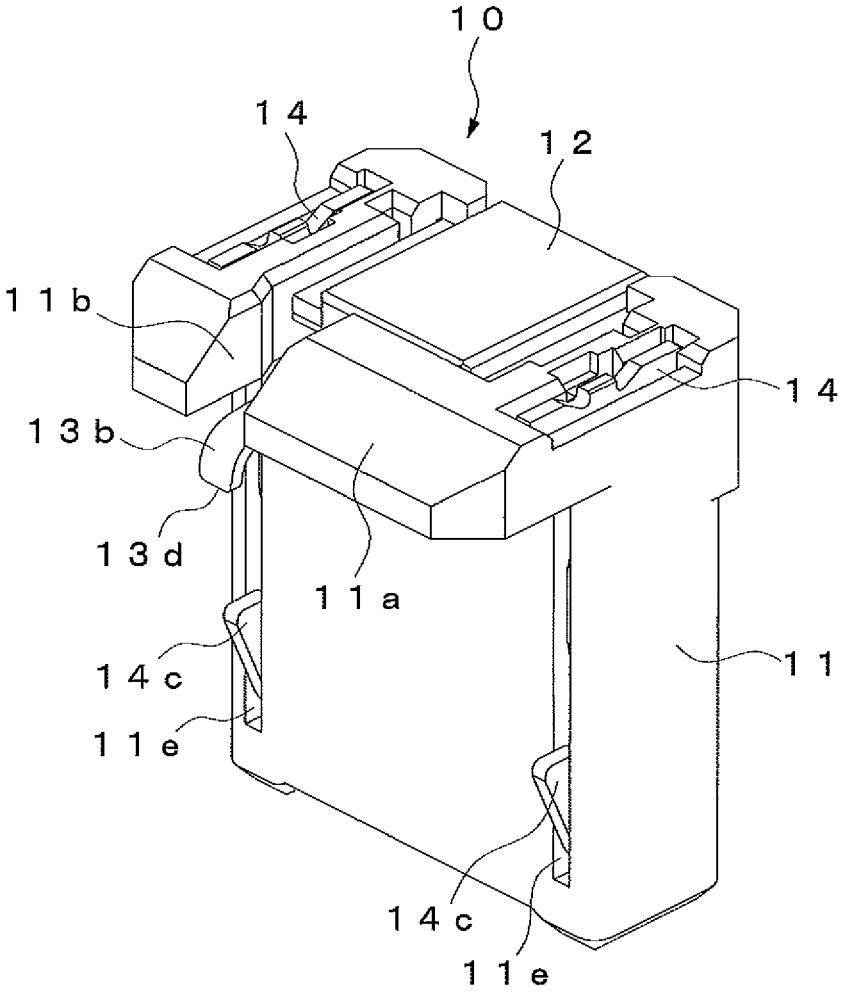
FIG. 1 is a top surface-side perspective view of a connector according to one embodiment of the present invention.
Figure 2:
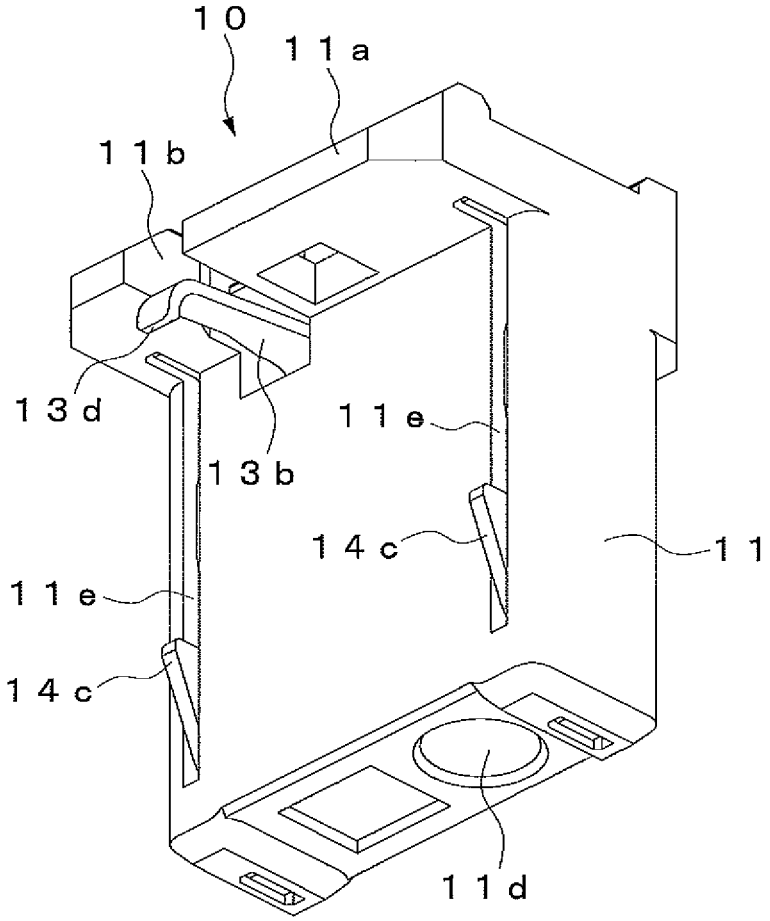
FIG. 2 is a lower surface-side perspective view of the connector.
Figure 3:
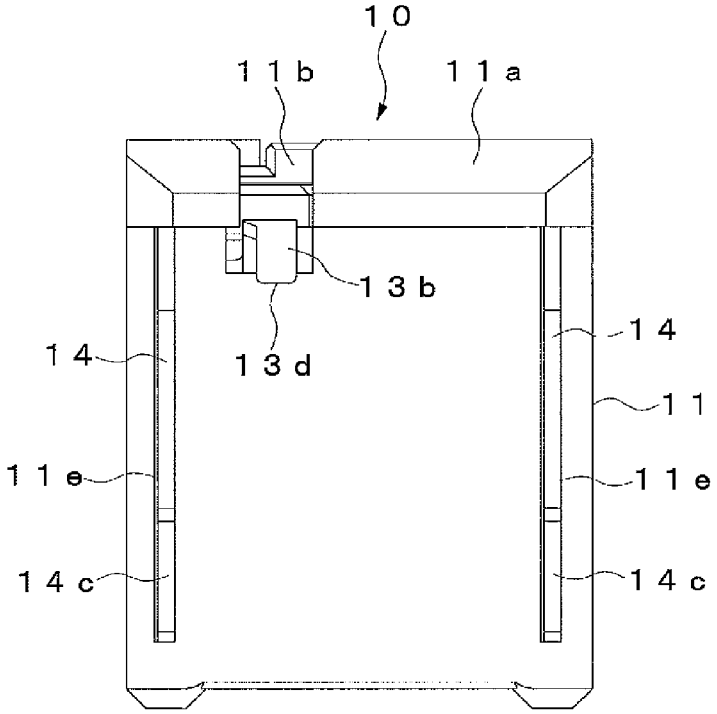
FIG. 3 is a front view of the connector.
Figure 4:
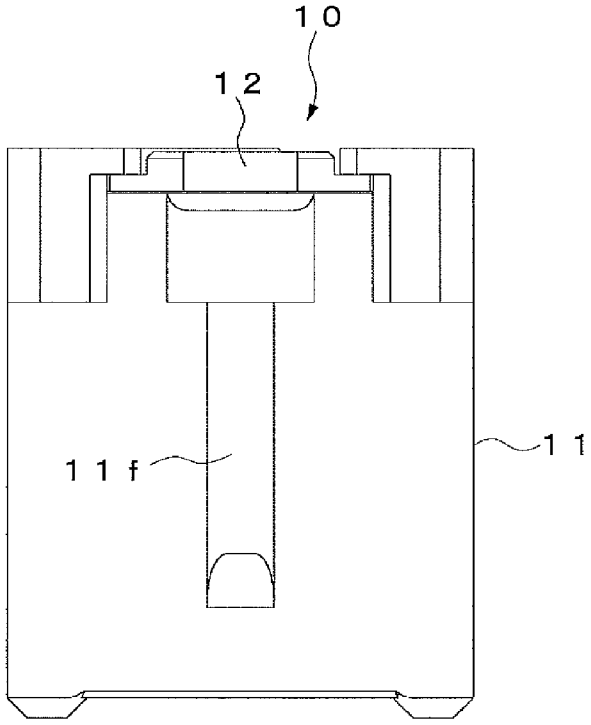
FIG. 4 is a rear view of the connector.
Figure 5:
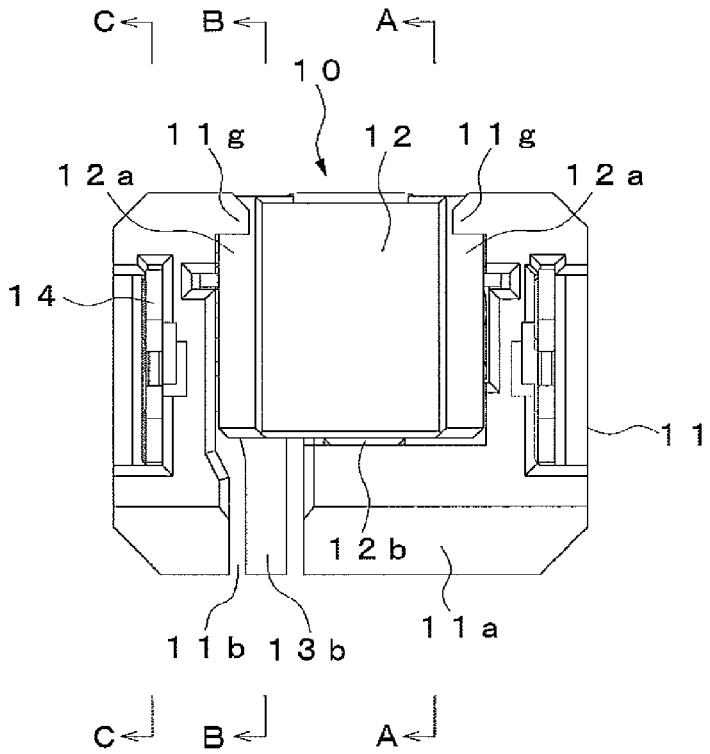
FIG. 5 is a plan view of the connector.
Figure 6:
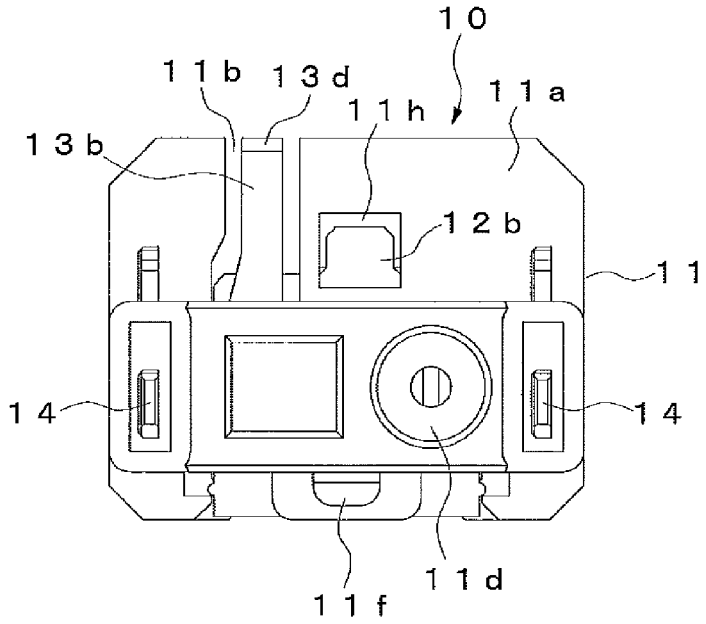
FIG. 6 is a bottom view of the connector.
Figure 7:
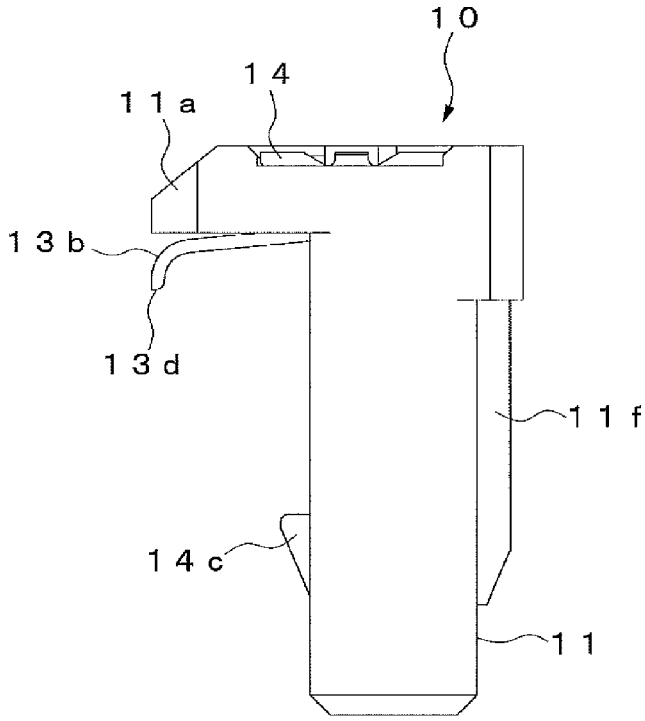
FIG. 7 is a side view of the connector.
Figure 8:
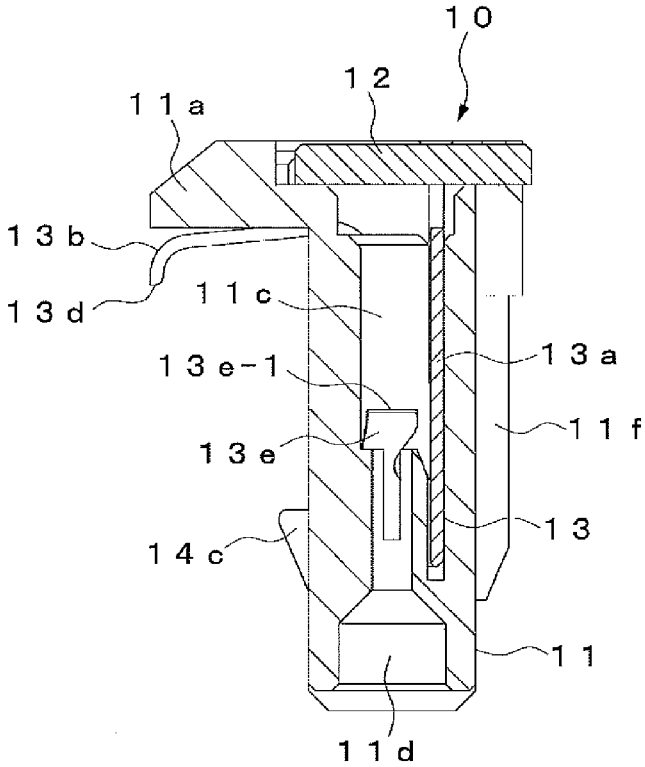
FIG. 8 is a cross-sectional view taken along the arrowed line A-A of FIG. 5.
Figure 9:
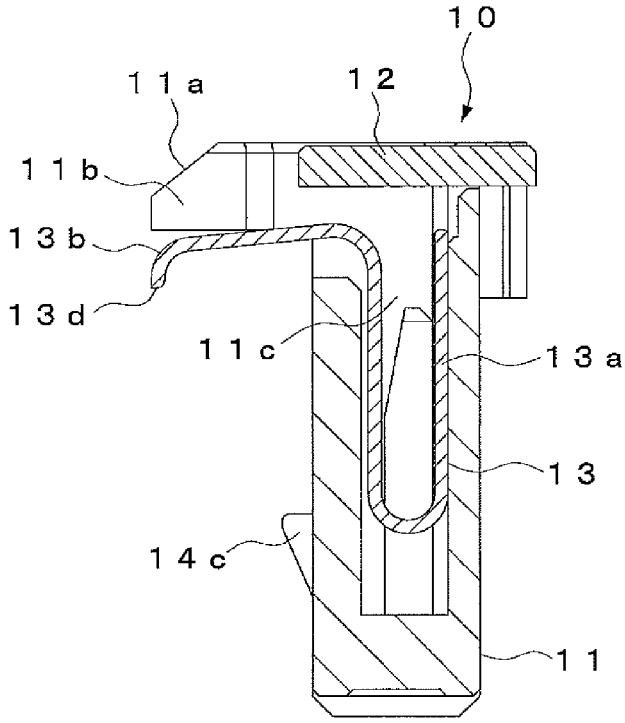
FIG. 9 is a cross-sectional view taken along the arrowed line B-B of FIG. 5.
Figure 10:
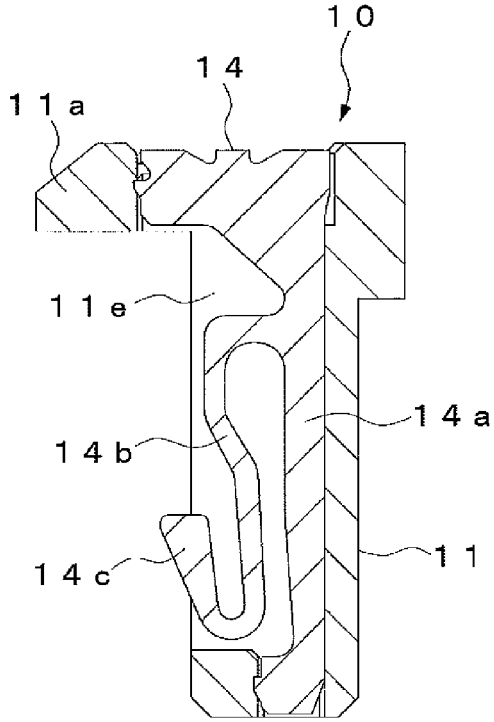
FIG. 10 is a cross-sectional view taken along the arrowed line C-C of FIG. 5.
Figure 11:
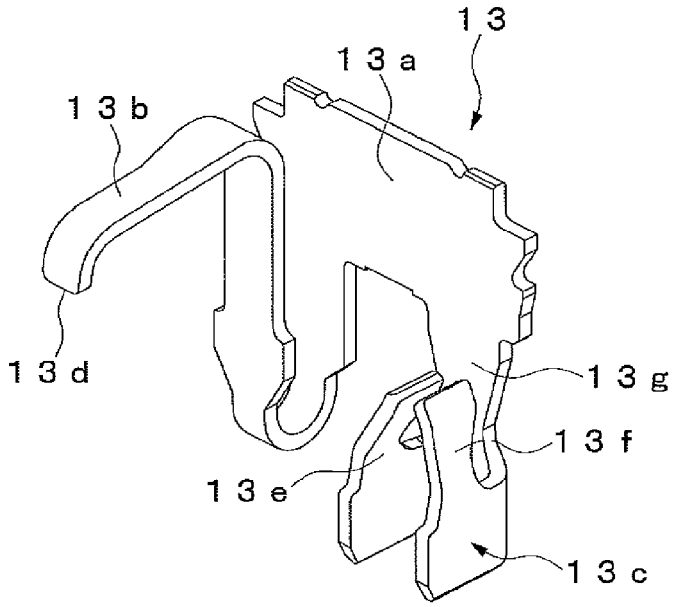
FIG. 11 is a perspective view of a terminal.
Figure 12:
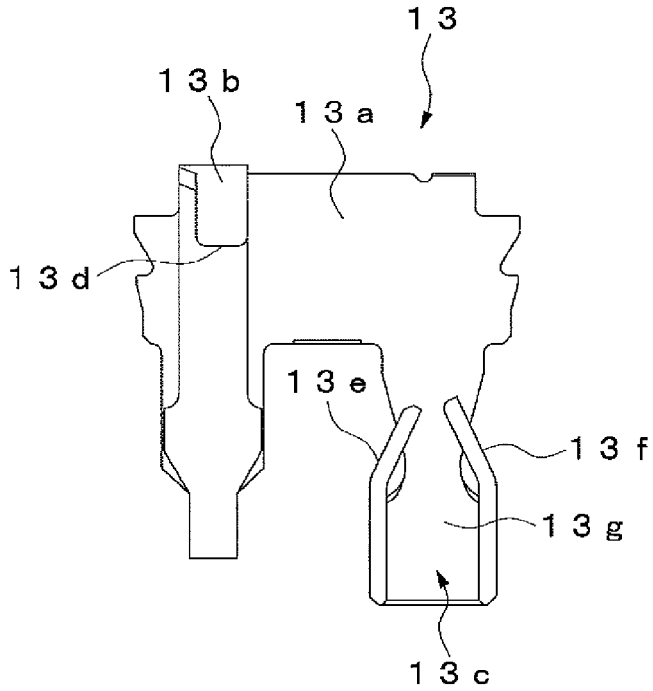
FIG. 12 is a front view of the terminal.
Figure 13:
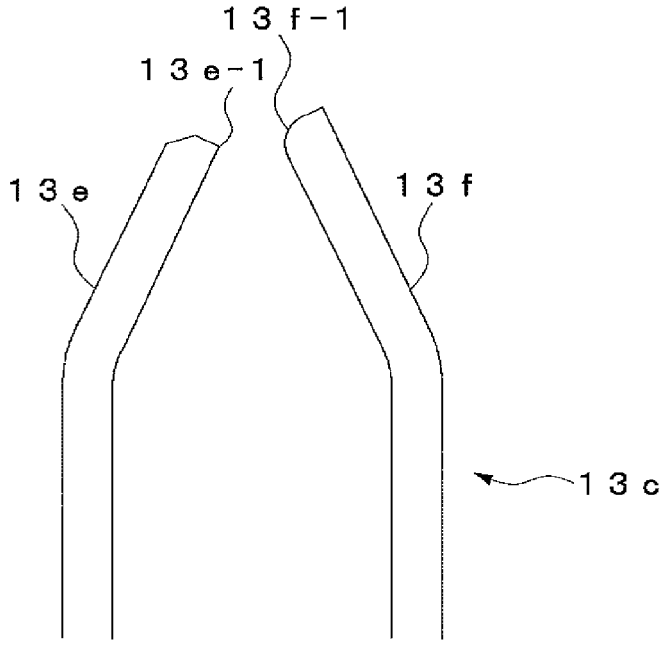
FIG. 13 is a front view of a substantial part of the terminal.
Figure 14:
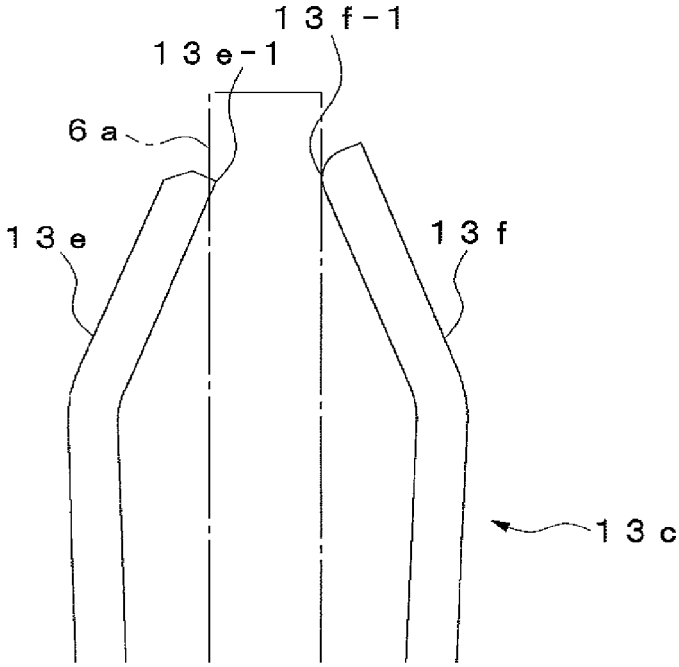
FIG. 14 is a front view illustrating the substantial part of the terminal to which a cable is connected.
Figure 15:
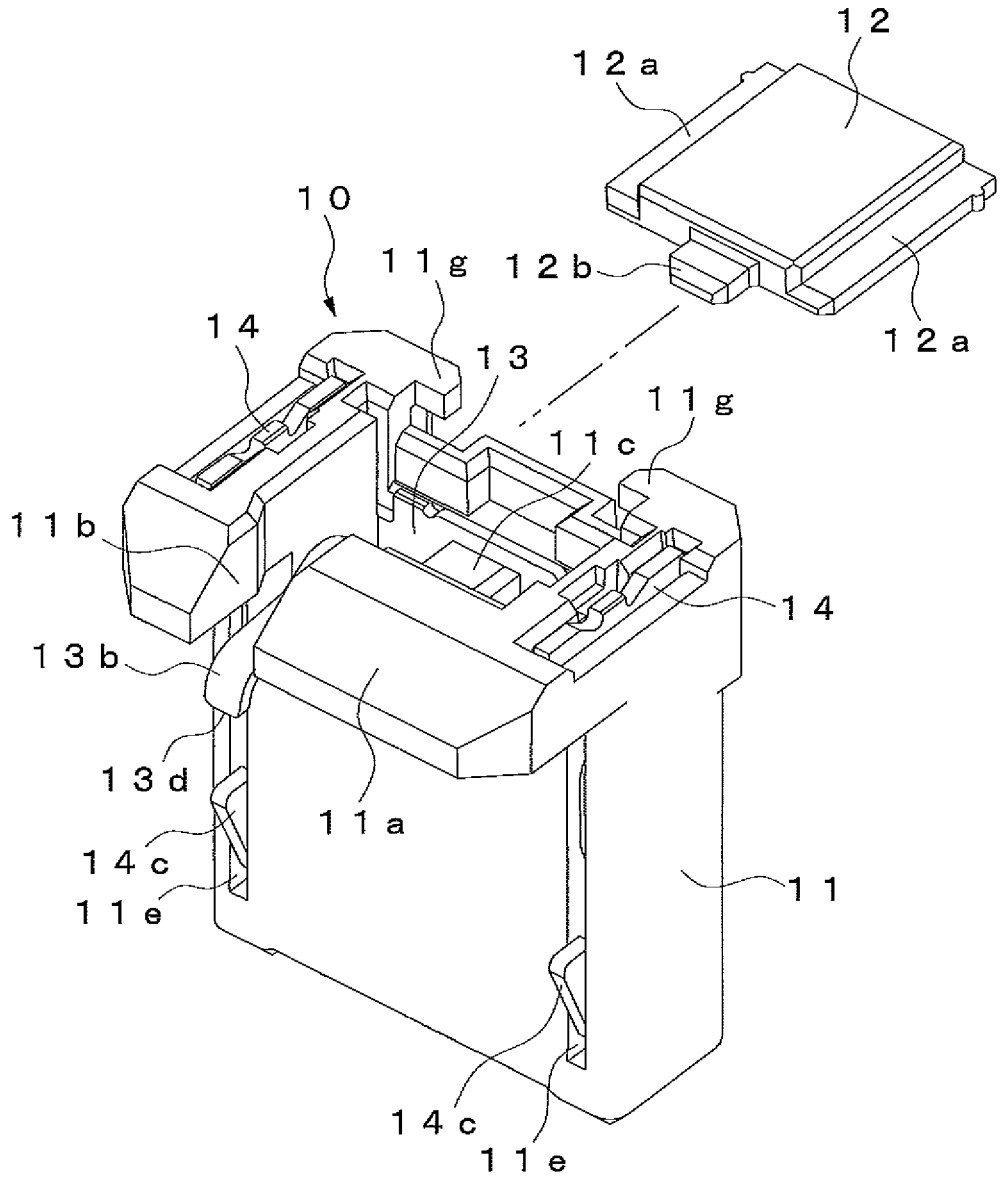
FIG. 15 is a top surface-side exploded perspective view of the connector.
Figure 16:
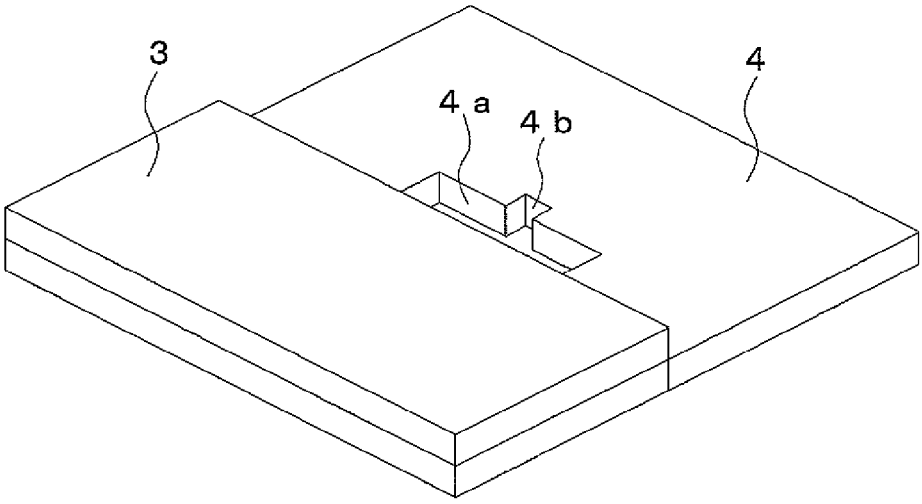
FIG. 16 is a partial perspective view of an LED board and a mounting board.

Next, a cable 6 with the lead wire 6*a* thereof exposed by removing the cladding clad of the leading end of the cable is inserted into the insertion port 11*d* of the connector main body 11 to connect the cable 6 to the terminal 13. At that time, the lead wire 6*a* of the cable 6 is inserted between the respective contact pieces 13*e* and 13*f* of the cable connecting portion 13*c*, as illustrated in FIG. 14. Thus, the respective contact pieces 13*e* and 13*f* are forced to widen while being placed in contact with the lead wire 6*a*. Consequently, the respective contact pieces 13*e* and 13*f* make pressure contact with the lead wire 6*a*, thereby connecting the cable 6 to the terminal 13. At that time, the first contacting portion 13*e*-1 of the first contact piece 13*e* comes into contact with the lead wire 6*a* so as to cut thereinto. Accordingly, the displacement of the lead wire 6*a* in the counter-insertion direction thereof is restricted, thereby preventing the lead wire 6*a* from being disconnected. On the other hand, the second contacting portion 13*f*-1 of the second contact piece 13*f* slidably makes surface contact with the lead wire 6*a* without cutting thereinto, thereby securing a sufficient area of contact between the second contact piece 13*f* and the lead wire 6*a*. Since the first and second contacting portions 13*e*-1 and 13*f*-1 are disposed so as to be opposed to each other in a direction orthogonal to the insertion direction of the lead wire 6*a* in this case, pressing forces from the respective contacting portions 13*e*-1 and 13*f*-1 are applied to axially the same position of the lead wire 6*a*.

A pair of connectors 10 are mounted on the LED board 3 and the mounting board 4 as illustrated in FIG. 21. A cable 6 connected to one connector 10 is connected to the positive electrode of the base 2*a*, and a cable 6 connected to the other connector 10 is connected to the negative electrode of the base 2*a*.

According to the connector 10 of the present embodiment, the board connecting portion 13*b* formed in the terminal 13 so as to be elastically deformable in the vertical direction thereof is brought into abutment with the top surface of the LED board 3 to make the board connecting portion 13*b* and the LED board 3 electrically conductive to each other. In addition, the locking part 14*c* of each lock member 14 is locked to the bottom surface of the mounting board 4 to hold the board connecting portion 13*b* of the terminal 13 in a state of being crimped on the top surface of the LED board 3. Consequently, the terminal 13 can be easily connected to the LED board 3 without having to solder the terminal 13 thereto, thereby enabling the work of mounting the connectors 10 to be done extremely easily.

In this case, the locking part 14*c* of each lock member 14 deforms elastically while abutting on an edge portion of the mounting hole 4*a* when the connector main body 11 is inserted into the mounting hole 4*a* of the mounting board 4. The locking part 14*c* restores its original state and is locked to the bottom surface of the mounting board 4 when the locking part 14*c* climbs over the edge portion of the mounting hole 4*a*. Consequently, the resistance of insertion into the mounting hole 4*a* can be reduced by the elastic deformation of the locking part 14*c*. Furthermore, the locking part 14*c* can be securely locked to the bottom surface of the mounting board 4 by the restoration of the locking part 14*c*.

In addition, the terminal housing 11*c* for housing the terminal 13 from an opening located on the top surface side of the LED board 3 is provided within the connector main body 11, and the top-surface opening of the terminal housing 11*c* is covered with the top cover 12 attached to the connector main body 11. Consequently, the interior portion of the terminal housing 11*c* is not exposed on the top surface of the connector main body 11. Thus, LED light can be securely reflected by the top surface of the connector main body 11 and the top cover 12. Making the color of the top surface of the connector main body 11 and the top cover 12 high in reflectance at that time prevents the top surface side of the LED board 3 from being darkened by the connector main body 11 even if the top surface side of the connector main body 11 is located on the top surface of the LED board 3. Thus, this coloring method has the advantage of not degrading illumination effects.

Yet additionally, the cable connecting portion 13*c* to which a cable 6 can be connected from the outside is provided integrally with the terminal 13. Consequently, any terminals for cable connection need not be provided separately, thereby enabling reduction in the number of components.

Still additionally, the first contacting portion 13*e*-1 adapted to cut into the lead wire 6*a* of a cable 6 to restrict the displacement of the lead wire 6*a* in the counter-insertion direction thereof is provided in the leading-end corner of the first contact piece 13*e* of the terminal 13. Furthermore, the second contacting portion 13*f*-1 with which the lead wire 6*a* slidably makes contact is provided in the leading end of the second contact piece 13*f* of the terminal 13. Consequently, the first contacting portion 13*e*-1 can prevent the lead wire 6*a* from being disconnected, and the second contacting portion 13*f*-1 can secure a sufficient area of contact with the lead wire 6*a*. Thus, the lead wire 6*a* can be securely retained without degrading connection reliability.

Since the second contacting portion 13*f*-1 is formed by chamfering the leading-end corner of the second contact piece 13*f* in this case, the leading-end side of the second contact piece 13*f* need not be bent to form a curved-surface contacting portion. Consequently, the second contact piece 13*f* can be easily formed into a simple shape.

Still additionally, the first and second contacting portions 13*e*-1 and 13*f*-1 are disposed so as to be opposed to each other in a direction orthogonal to the insertion direction of the lead wire 6*a*. Consequently, pressing forces from the respective contacting portions 13*e*-1 and 13*f*-1 can be applied to axially the same position of the lead wire 6*a*. Thus, the lead wire 6*a* can be securely clamped by the respective contacting portions 13*e* and 13*f*.

Still additionally, the first and second contact pieces 13*e* and 13*f* are formed by bending and raising both sides of the extension part 13*g* of the terminal 13, so as to be opposed to each other. Consequently, the respective contact pieces 13*e* and 13*f* can be formed easily to improve productivity.

Note that although the connectors 10 to be connected to the LED board 3 of a bulb-type lamp have been shown in the above-described embodiment, the present invention is not limited to use in the board of a bulb-type lamp. The present invention can also be applied to connectors for connection to boards of other equipment.

Also note that although the terminal 13 of each connector 10 to be connected to the LED board 3 has been shown in the above-described embodiment, the electrical connection terminal of the present invention can also be applied to terminals and the like which can be directly mounted on other types of connectors and boards.

REFERENCE SIGNS LIST

1: Bulb-type lamp, 3: LED board, 4: Mounting board, 4*a*: Mounting hole, 6: Cable, 10: Connector, 11: Connector main body, 11*c*: Terminal housing, 12: Top cover, 13: Terminal, 13*b*: Board connecting portion, 13*c*: Cable connecting portion, 13*e*: First contact piece, 13*f*: Second contact piece, 13*e*-1: First contacting portion, and 13*f*-1: Second contacting portion.

The invention claimed is:

1. An electrical connection terminal comprising:

a first contact piece and a second contact piece both disposed opposite to each other in a thickness direction thereof and connected to a connection object through the respective contact pieces as the result of the connection object being inserted therebetween, wherein both the first contact piece and the second contact piece are obliquely formed, wherein both a leading-end corner of the first contact piece and a leading end-corner of the second contact piece extend toward an insertion direction of the connection object and come close to each other and the respective contact pieces are elastically deformable in the mutually-opposed direction thereof;

wherein the first contact piece comprises a first contacting portion that is a substantially orthogonal edge;

wherein the first contacting portion is adapted to cut into the connection object to restrict the displacement thereof in a counter-insertion direction and the first contacting portion is provided in the leading-end corner of the first contact piece;

wherein the second contact piece comprises a second contacting portion with which the connection object slidably makes contact is provided in the leading-end corner of the second contact piece; and wherein the second contacting portion is formed by chamfering the leading-end corner of the second contact piece into a curved-surface shape.

2. The electrical connection terminal according to claim 1, wherein the connection object is a lead wire.

3. A connector comprising an electrical connection terminal according to claim 1.

4. The electrical connection terminal according to claim 1, wherein the first and second contacting portions are disposed so as to be opposed to each other in a direction orthogonal to the insertion direction of the connection object.

5. The electrical connection terminal according to claim 4, wherein the first and second contact pieces are formed by bending and raising both sides of a predetermined portion of a terminal main body, so as to be opposed to each other.

6. The electrical connection terminal according to claim 4, wherein the connection object is a lead wire.

7. The electrical connection terminal according to claim 1, wherein the first and second contact pieces are formed by bending and raising both sides of a predetermined portion of a terminal main body, so as to be opposed to each other.

8. The electrical connection terminal according to claim 7, wherein the connection object is a lead wire.

* * * * *